United States Patent [19]

Komberec et al.

[11] 3,945,313

[45] Mar. 23, 1976

[54] VERTICAL BALER

[76] Inventors: Harold L. Komberec; Dillon K. Kilcup, both of Spokane Industrial Park. Bldg. 13, Spokane, Wash. 99216

[22] Filed: Feb. 6, 1975

[21] Appl. No.: 547,734

[52] U.S. Cl. ..... 100/34; 100/52; 100/215; 100/218; 100/255; 220/333

[51] Int. Cl.[2] ..... B65B 13/18; B30B 15/32

[58] Field of Search ..... 100/215, 218, 245, 255, 100/214, 3, 34, 269 R, 52; 220/333, 332, 329

[56] References Cited

UNITED STATES PATENTS

| | | | |
|---|---|---|---|
| 314,523 | 3/1885 | Duval | 100/218 |
| 1,040,396 | 10/1912 | Paal | 100/218 |
| 1,112,723 | 10/1914 | Schick | 100/255 |
| 1,465,055 | 8/1923 | Persson | 220/333 |
| 3,827,349 | 8/1974 | Gilman | 100/3 X |
| 3,851,577 | 12/1974 | Newcom et al. | 100/218 |
| 3,885,466 | 5/1975 | Cerniglia | 100/218 |

*Primary Examiner*—Billy J. Wilhite

[57] ABSTRACT

A vertically acting baler adapted particularly to bale waste paper products. The baler provides for ram alignment on three sides, bale tying by pre-placed ties and bale relief for easy ejection by a unique bell-crank type ejecting mechanism.

2 Claims, 6 Drawing Figures

13
41
2
39
38
35
11
37
23
21
18
23
39
27
10
36
48
16
2
33
21
32
26
23
35
24
24
17
47
22
19
32
30
22
29
27
49
44
31
20
32
23
21
28
45
43
15
12
46
25

VERTICAL BALER

BACKGROUND OF INVENTION

A. FIELD OF INVENTION

This invention relates generally to stationary, vertically acting balers and particularly to such devices that provide pre-positioned ties and bale relief for ejection at support floor level.

B. DESCRIPTION OF PRIOR ART

Mechanical balers of one sort or another have been known since the very early periods of mechanics, and with this long historicity the generic device has tended to evolve into quite distinctive species, each generally related to quite a specialized function and usually to a specific product. With the advent of the present day philosophy espousing environmental protection, and our culture having the sophisticated merchandising systems that it does, the disposal of wastes created by these merchandising systems has become a problem. The instant invention was created to and has found commercial success in baling waste packaging materials, particularly of a paper-like nature, to simplify its handling, storage and disposal.

Our baler has evolved from the general principles known in the prior art to provide specific novel structures that well adapt it to the particularities of the baling of the waste that it is created for. The baler is of a stationary type with a vertical baling stroke as it normally is used by positionally established businesses in a location that has adequate vertical clearance. The baler is formed with peripheral baling chamber surfaces of a slat-like nature to aid the baling operation by reducing friction during its course and to allow the pre-placement of ties about the baling area before the bale is formed so that they need not be placed after bale formation. This materially increases both the ease and safety of operation of the device. Our baler provides guidance support for the compressing ram on three sides to require foul proof, non-binding ram motion while yet allowing for bale relief from the restraining peripheral elements of the baling chamber after bale formation for simple bale ejection. The bale is ejected by a novel bell-crank type ejector system that is and may be of simple economic construction because of the bale relief system.

These features, though not necessarily novel per se, have been combined in our baler to create the specific structure that has found ready market acceptance for its intended purpose. The novelty of our invention over the prior art devices resides in the union of all of these various structural elements acting in combination to create a complete machine not heretofore known, either structurally or functionally.

SUMMARY OF INVENTION

Our invention provides a baling chamber, peripherally defined by bottom and four vertical sides, with a ram adapted for vertical motion therein. The lower portion of the first vertical side or front is pivotably mounted at one lateral edge and releasably fastenable at the other to open for bale removal. Above this lower front panel is a vertically movable gate that opens for access and closes during operation to serve as a guard. The lower portion of the side of the bale chamber, adjacent to the fastening edge of the front, is similarly pivotably mounted so that it may move outwardly to relieve pressure on a bale to be ejected. The ram is slidably guided on three sides by rails to maintain aligned motion within the baling chamber.

The peripheral elements of the baling chamber are formed of spaced slats to reduce baling friction and provide channels for establishment of bale ties. Plural hooks are established in the upper portion of the channels between slats on the rearward wall to hold bale ties that pass vertically downward across the bottom and up the front edge of the baling chamber, to a position above the effective baling area, so that they may be tied across the top of the bale when completed. The baling ram may be operated only when the safety gate is closed and ceases operation in response to position sensitive switch activation indicating a bale of completed size.

An ejector mechanism provides a bell-crank lever operated by a simple winch mounted on the frame exterior to move a bell-crank arm positioned between the bottom baling chamber slats vertically upward to eject a bale forwardly from the baling chamber.

In providing such a mechanism it is:

A principal object of our invention to provide a stationary vertical baler particularly adapted to bale waste packaging products.

A further object of our invention to provide such a baler that guides a baling ram on three sides for alignment but yet allows front opening for bale ejectment and side opening for bale relief prior to ejection.

A further object of our invention to provides such a mechanism that allows pre-placement of bale ties for simple and safe tying after bale formation.

A still further object of our invention to provide a novel winch operated bell-crank type mechanism for ejection of formed bales at the level of baler support.

A still further object of our invention to provide such a baler that is of new and novel design, of rugged and durable nature, of simple and economic manufacture and otherwise well adapted for the uses and purposes for which it is intended.

Other and further objects of our invention will appear from the following specification and accompanying drawings which form a part of this specification. In carrying out the objects of our invention, however, it is to be remembered that its accidental features are susceptible of change in design and structural arrangement with only one preferred and practical embodiment being illustrated in the accompanying drawings, as is required.

BRIEF DESCRIPTION OF DRAWINGS

In the accompanying drawings which form a part hereof and wherein like numbers of reference refer to similar parts throughout.

BRIEF DESCRIPTION OF PREFERRED EMBODIMENT

Figure 1:
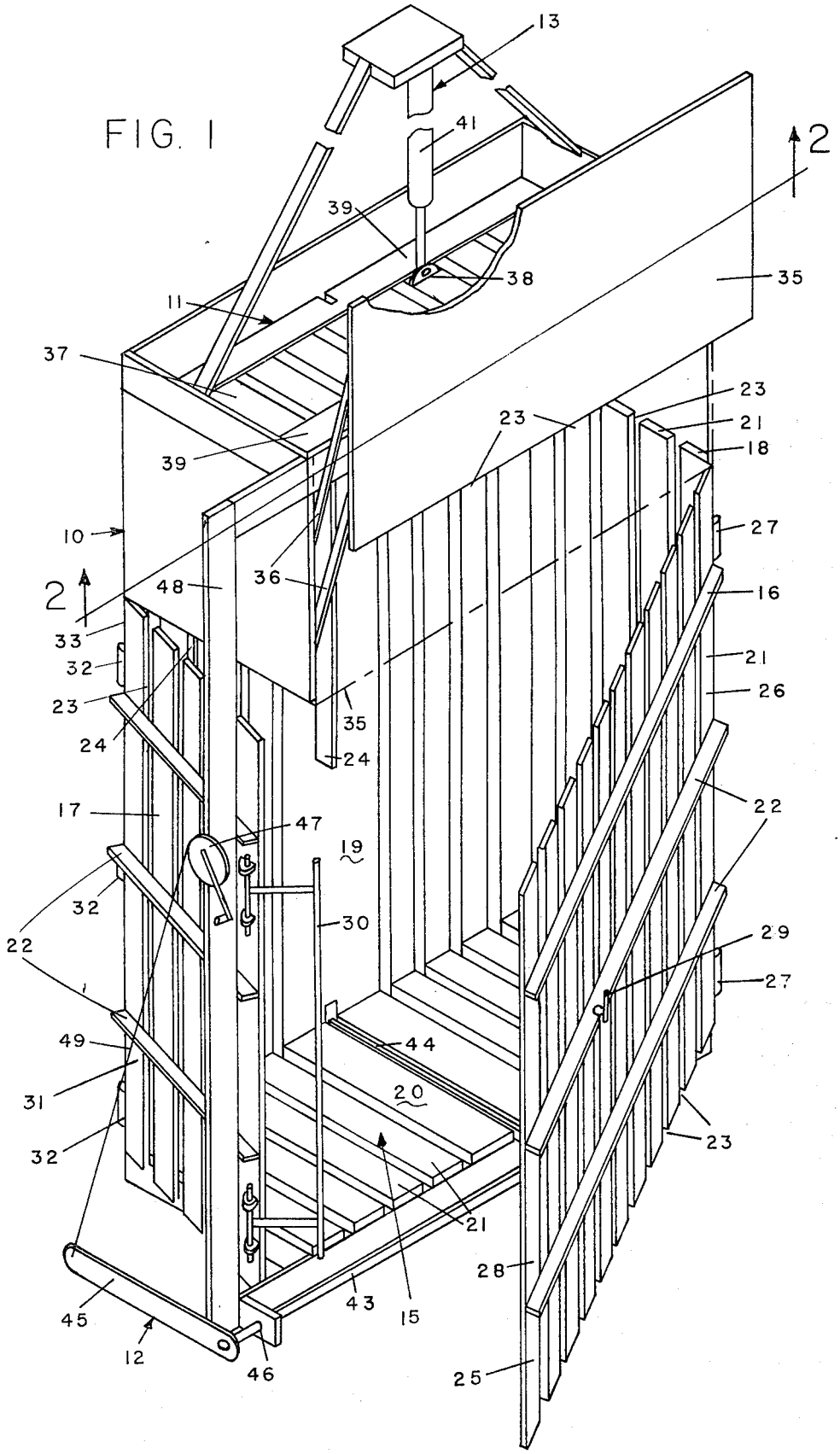
FIG. 1 is an isometric surface view of our baler showing its various parts, their configuration and relationship.
Figure 2:
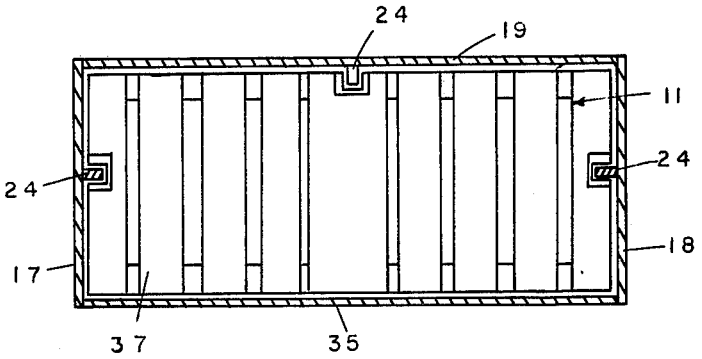
FIG. 2 is a horizontal cross-sectional view of the baler of FIG. 1, taken on the line 2—2 thereon in the direction indicated by the arrows, to show the details of the internal structure of our baler.
Figure 3:
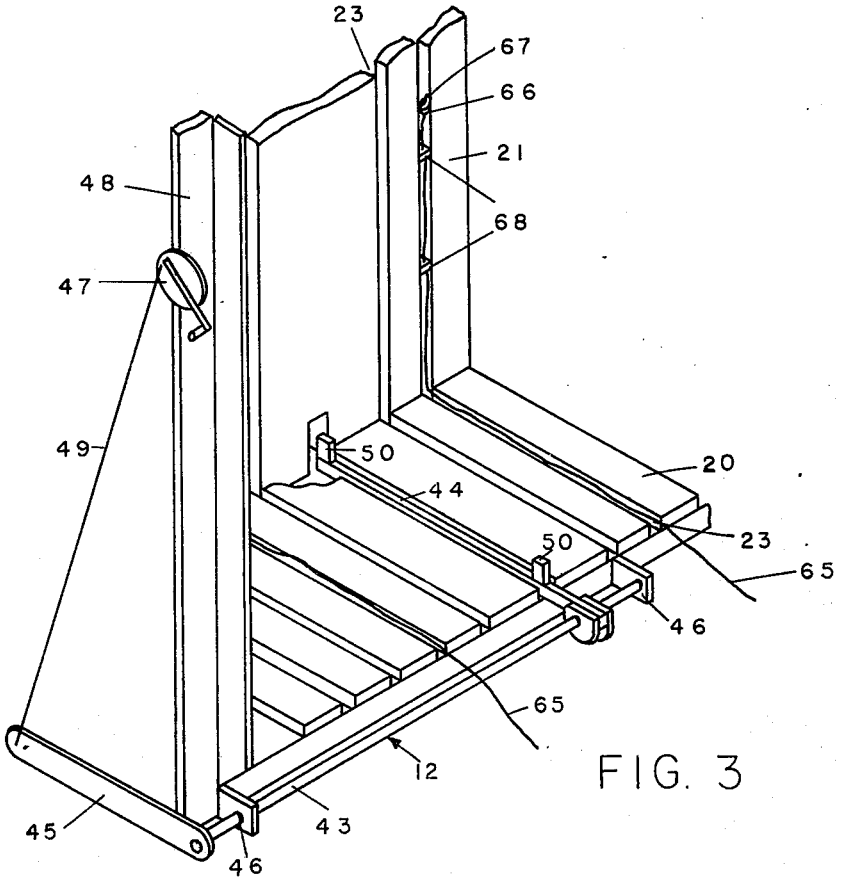
FIG. 3 is an isolated isometric view of the winch operated bell-crank ejector system of our invention showing its structure and operation in greater detail.

Referring now to the drawings in more detail and particularly to that of FIG. 1, it will there be seen that our invention comprises generally baler frame structure 10 defining vertical baling chamber 15 in which baling ram 11 is vertically moved by hydraulic system 13 responsively to electrical control system 14; the completed bale is removed from the baling chamber by bale ejector mechanism 12.

Baler frame structure 10 provides front 16, opposed similar sides 17, 18 and back 19 all structurally communicating with bottom 20 to define open topped, vertically extending baling chamber 15. These frame members are formed of elongate slat-like elements 21 maintained in parallel spaced adjacency by external frame 22 so that there are elongate voids or channels 23 opening into the baling chamber between each of the slat-like elements. The slat-like elements 21 of bottom 20 are aligned in such fashion that their channels 23 align with the channels between the slats in front and back elements 16, 19 to provide continuous channels extending along these three surfaces to allow pre-placement of ties as hereinafter described. The upper portions of both sides 17, 18 and back 19 are provided with medially positioned vertically extending siderails 24 to direct motion of the baling ram in the baling and maintain proper alignment therein.

The lower portion of front 16 provides bale removal door 25 supported at edge 26 by plural hinges 27 carried on baler side 18 for swing about a vertical axis to allow the bale removal door to swing horizontally outwardly to completely open the front of the bale chamber. The opposite vertical edge 28 of the door carries pivotably mounted latch mechanism 29 to cooperate with the pivotably mounted latch bar 30 carried by the forward edge of side 17 to fasten all parts securely together by yet provide for simple unfastening.

The lower portion of side 17 provides bale relief door 31. This door is pivotably mounted on plural hinges 32 structurally carried by the lateral edge part 33 of back 19 to swing in a horizontal plane about a vertical axis to some slight degree to relieve pressure upon a formed bale. Latch bar 30 is pivotably mounted, inwardly adjacent the forward edge of bale relief door 31, so that it may swing in a horizontal plane over latch mechanism 29 on the bale removal door 25 to be solidly, yet releasably, latched thereby.

Baler front 16 immediately above bale removal door 25 provides input door 35. This door is mounted by plural opposed, lever type hinge bars 36, pivotably communicating with the lateral edges of door 35 at one end and with baler frame 10 at the other to provide a vertical pivotably motion for the imput door from the open position, as illustrated in FIG. 1 in solid line, to the closed position illustrated as dotted line. The method of mounting and pivoting this door, and in fact the bale relief door and bale removal door, is not critical and various other mounting means may be used so long as the doors have the motion specified to accomplish their purposes.

The bale frame structure described is preferably formed from mild steel elements of the configuration specified and illustrated. These elements are structurally joined by welding in the preferred embodiment illustrated. The inwardly facing surfaces of the various baler frame members defining the baling chamber should be reasonably smooth to reduce friction during the baling operation, but it has been found that the surface of normally available commercial structural steel is quite appropriate for this purpose. The sizing of the various structural elements is not critical to our invention so long as it be such as to provide sufficient strength and rigidity to accomplish its purposes. Particular structural parameters may be readily determined by methods well known in the mechanical arts, and are not per se a part of our invention.

Figure 5:
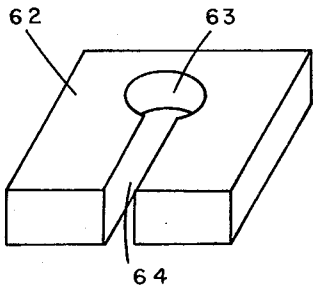
FIG. 5 is an enlarged isometric view of one of the tying wire holders of our invention.
Figure 4:
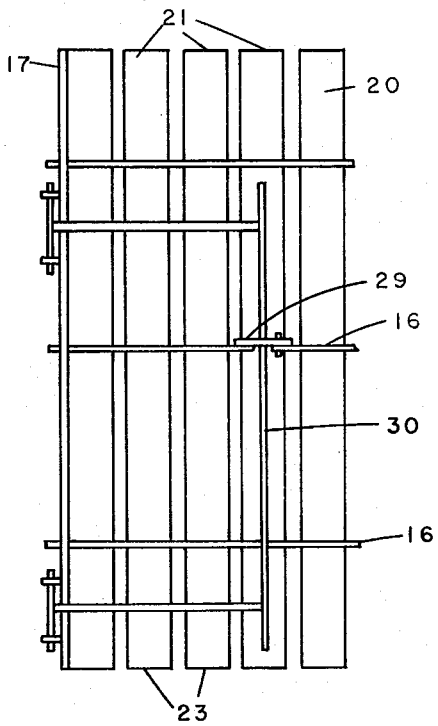
FIG. 4 is a somewhat enlarged, detailed view of the latch mechanism of the front bale removal door and lower side relief panel of our baler.

Plural baling wire hooks 67 are carried by the baler frame structure in the upper part of back, above the normal top of a bale, in channels 23 between slat-like elements 21. Plural wire holders 68 are carried by the baler frame structure at spaced distances in the channels in the back below hooks 67 and in the channels of the bottom and bale removal door of the front 16. Each wire holder is formed from resilient material defining central wire hole 63 communicating through the holder by channel 64 to the edge of the holder facing the baling chamber as particularly illustrated in FIG. 5.

Baling wires 65 are elongate elements of length sufficient to pass about a bale with sufficient surplus to allow fastening of the ends by twisting or otherwise. One end of each baling wire is formed with a loop 66 to allow fastening on baling wire hooks 67. The baling wires found most desirable are of galvenized iron wire of approximately 14 gauge.

Baling ram 11 provides substantial planar baling platten 37 activated through medially positioned ram stem structure 38. The baling platten is again formed with elongate slat-like elements maintained in spaced parallel position by supportative peripheral frame 39 to create channels between the slats. Peripheral frame 39 of the baling ram is provided with three channel-type sliding bearings, appropriately positioned in the medial part of the two sides and back, to slide upon guide rails 24 carried thereby to provide three point alignment for the ram during its course of vertical motion in the baling chamber. The peripheral configuration and sizing of the ram should be just slightly smaller than the inside dimension of a horizontal plane through the baling chamber so that it may move readily therein but yet compress unconsolidated matter carried within that chamber. The baling ram, again, is preferably formed from mild steel elements joined by welding and is of size and configuration as determined by normal methods of mechanics.

Hydraulic system 13 provides, in this instance, at least one vertically oriented hydraulic cylinder 41 structurally carried by the upper part of the baler frame structure with its piston rod mechanically linked to ram stem structure 38 to move the baling ram 11 vertically within the baling chamber. Cylinder 41 is of the double acting variety and must have a stroke sufficient to move the platten 37 of baling ram 11 from its lowermost baling position to its uppermost position above or substantially above imput door 35 to allow imput of material to be baled. Again, the exact nature of the hydraulic pressing system of our invention is not critical to it and it may comprise a single cylinder as illustrated, a plurality of vertically disposed cylinders or in some instances where vertical clearance is a problem there may be an angularly disposed grouping of cylinders working through a scissors type linkage to provide the vertical motion of the baling ram.

Bale ejector mechanism 12 provides the ejector bell-crank having elongate rod-like body portion 43 structurally connecting rearwardly extending bale ejector arm 44 at its laterally inner end and rearwardly extending activating arm 45 at its laterally outer end, both ejector arm and activator arm extending substantially in parallel directions. Body portion 45 is pivotably carried by journals 46 along the forward upper edge of bottom 20 with bale ejector arm 44 designed to fit within one of the channels 23 in the bottom element so that in its null position it is below the baling surface thereof.

Activating winch 47, carried on bracket 48 by the medial forward part of side 17, communicates with the lateral end part of the activating arm 45 by cable 49. A part of the upper surface of bale ejector arm 45 normally is provided with tooth-like protuberances 50 to contact a formed bale to prevent slippage and assure ejectment.

Figure 6:
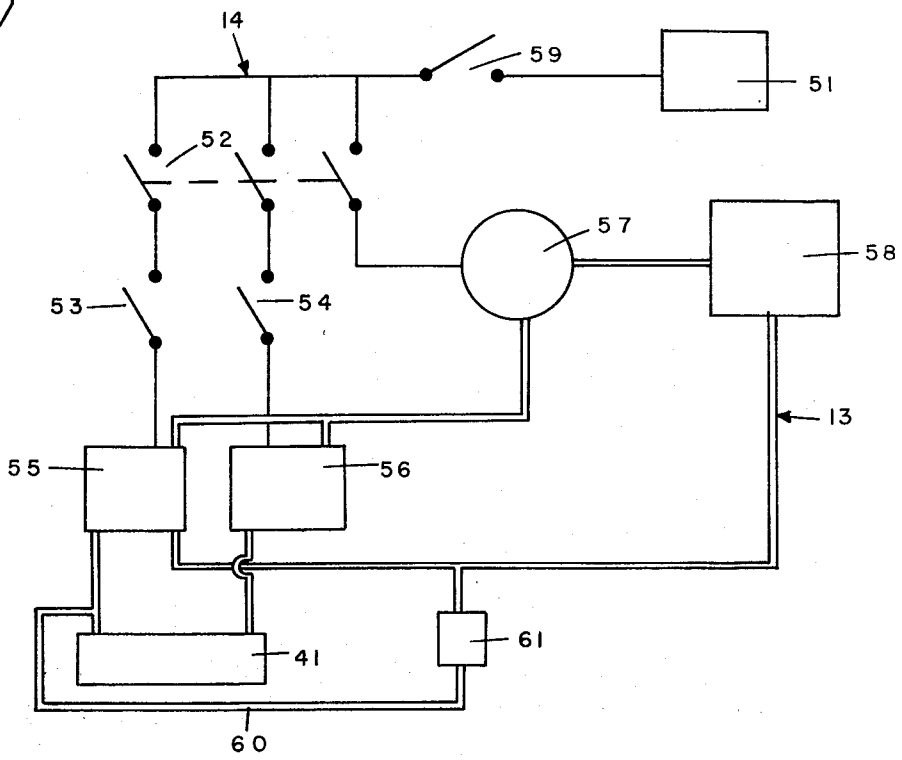
FIG. 6 is a diagrammatic representation of the electrical and hydraulic circuitry of our invention, illustrated in normal symbology.

Electrical control circuitry 14 of our invention is diagrammatically illustrated in FIG. 6. An external source 51 furnishes electrical current through three-pole single throw switch 52. This current is then supplied through upper limit switch 53 to solenoid controlled hydraulic valve 55 controling the downstroke of cylinder 41 and through lower limit switch 54 controlling hydraulic valve 56 on the other side of the piston of cylinder 41 to control its upstroke. Current is supplied through the third pole of switch 52 to pump 57 which pressurize hydraulic fluid received from reservoir 58 to supply it to the hydraulic cylinder through valves 55 and 56 from whence it is returned to the reservoir 58. With this circuitry the up and down motion of the baling platten may be controlled either by the limit switches or by two poles of switch 52 and the pump may be controlled by the third pole of that switch. Safety switch 59 is normally included in the circuitry for use, in most areas, to insure safety of operation of the device. This switch must be closed to furnish any power for motion of the platten and it is normally activated by closure of the imput door 35. The hydraulic system will normally be furnished with pressure by-pass 60 controlled by pressure sensitive valves 61 to allow continued holding operation of the baling ram at a predetermined pressure.

Having thusly described the structure of our invention, its operation may be more readily understood.

Firstly, a structure is formed according to the foregoing specification, positioned on an appropriate supportative surface, and furnished with electric current. If the baling ram be in the downward position it is manually raised to its upward position by manual operation of switch 52.

In this condition imput 35 is opened for access and plural baling wires 65, normally 4 in number, are placed by their loops 66 upon baling wire hooks 67. The wires are then brought downwardly in the channels between baling chamber slats and held in position by insertion through the respective wire holders 62. Each wire passes forwardly through the channel in bottom 20 and upwardly on the inside of the front 16 with the surplus end of each tie bent forwardly across the top of the bale removal door 25 to be maintained there by an appropriately placed wire holder. The doors are then all shut and locked into place.

Imput door 35 is then opened by moving it upwardly and waste to be baled is inserted through the opening created thereby and downwardly into the baling chamber. As the operation progresses imput door 35 is periodically closed and baling ram 11 moved downwardly by manual operation of the appropriate pole of switch 52 to compress matter in the baling chamber. It is to be noted that as this is done the ram's downward course of travel will be limited by the maximum pressure thereon by reason of the pressure by-pass route 60 controlled by settable pressure sensitive valves 61. The operation is continued until sufficient baled matter is present in the chamber so that in its downward course the baling ram does not operate the lower limit switch 54 because the bale is too large to allow it to pass downwardly past the switch. When this condition occurs the ram will remain down against the bale to signal completion of a bale of appropriate size.

At this point the ram is manually raised, the imput door 35 opened and the wire ties removed from their holding hooks 67 and brought forwardly across the top of the completed bale. The imput door is then shut and the baling ram brought down upon the bale to hold it while it is being tied. With the ram in a downward position and the bale being held by it, the bale removal door 25 is opened and the ends of each baling tie are fastened together in some fashion known in the baling arts. Imput door 35 is then closed, if necessary, the ram raised and the bale is ready for ejectment.

To eject the bale, the baler ejectment door and imput door if necessary are opened, winch 47 is operated to move activation arm 45 of the bale ejector forwardly and this in turn moves the bale ejector arm in an upward and forward direction to tip the bale out of the baling chamber in front of the bale removal door. The cycle is then completed, the baler may be closed and is then ready for repeat of the operation.

It is to be noted that with the operation of our baler the baling ram may be maintained in a down or pressure position if desired for extended periods of time. It has been found that this is desirable in baling waste paper as if it be held under pressure for some period of time it tends to maintain its compressed status and lose some of its plastic elasticity.

Having thusly described our invention, what we desire to protect by Letters Patent, and

What we claim is:

1. A baler for waste products comprising, in combination:

a baler frame structure having a bale removal door and providing spaced slat-like elements defining the bottom, two vertical sides, the front and back of a rectilinear baling chamber, the slats in the vertical surfaces being vertically oriented and those in the bottom being aligned with the vertical slats to form continuous channels in the baling chamber periphery with plural baling wire hooks carried by the baler frame structure in the said channels in the upper part of the back and plural spaced wire holders adapted to releasably hold baling wire in plural channels extending downwardly along the back from the baling wire hooks across the bottom and upwardly on the front to the top of said bale removal door, and vertically positioned guide rails carried in the medial part of the chamber defining surfaces of the opposed sides and back of the baler to guide the vertical motion of a baling ram therein;

said bale removal door being in the lowermost part of the front pivotably mounted for horizontal swing motion at one side edge and having first latching means at the second side edge;

an input door immediately above the bale removal door hingably mounted at its lateral edges on the baler frame structure for opening motion upward and outwardly;

a baling ram having a flat lower baling surface vertically movable within the baling chamber with bearing surfaces to fit upon and be slidably guided by the guide rails carried on the baling chamber facing surfaces of the baler frame structure; and hydraulic means of vertically moving the baling ram within and above the baling chamber responsive to manually activated electric controls.

2. The invention of claim 1 having bale ejector means comprising:

a bell-crank with an elongate body journaled for pivotable motion at the upper forward edge of the bottom element of the baler frame structure with a bale ejector arm extending perpendicularly therefrom into a medial channel between slats forming the bottom;

an activator arm extending perpendicularly from the bell-crank body substantially parallel to the bale ejector arm at a spaced distance laterally outward from the outer surface of the baler frame structure; and winch means mounted on the baler frame structure and communicating by cable with the activator arm to turn the activator arm and thusly the bale ejector arm upward and forward responsive to winch action to eject a bale from the bale chamber.

* * * * *